US010119279B2

(12) United States Patent
Brinkmann et al.

(10) Patent No.: US 10,119,279 B2
(45) Date of Patent: Nov. 6, 2018

(54) SCAFFOLDING COUPLER, STANDARD AND SCAFFOLDING SYSTEM

(71) Applicant: Scafom Holding B.V., Budel (NL)

(72) Inventors: Franciscus Jozef Leonardus Hubertus Brinkmann, Budel (NL); Guus Franciscus Johannes Kuunders, Budel (NL)

(73) Assignee: Scafom Holding B.V., Budel (NL)

( * ) Notice: Subject to any disclaimer, the term of this patent is extended or adjusted under 35 U.S.C. 154(b) by 0 days.

(21) Appl. No.: 15/315,751

(22) PCT Filed: Jun. 2, 2015

(86) PCT No.: PCT/NL2015/050392
§ 371 (c)(1),
(2) Date: Dec. 2, 2016

(87) PCT Pub. No.: WO2015/187010
PCT Pub. Date: Dec. 10, 2015

(65) Prior Publication Data

US 2017/0121986 A1 May 4, 2017

(30) Foreign Application Priority Data

Jun. 2, 2014 (NL) ..... 2012924

(51) Int. Cl.
*E04G 1/06* (2006.01)
*E04G 7/30* (2006.01)
(Continued)

(52) U.S. Cl.
CPC ..... *E04G 7/307* (2013.01); *E04G 1/06* (2013.01); *E04G 1/12* (2013.01); *E04G 7/301* (2013.01); *E04G 7/32* (2013.01)

(58) Field of Classification Search
CPC ..... E04G 7/307; E04G 1/06
See application file for complete search history.

(56) References Cited

U.S. PATENT DOCUMENTS 9,133,634 B2 * 9/2015 Brinkmann ..... E04G 7/307
9,683,380 B2 * 6/2017 Brinkmann ..... E04G 1/12

FOREIGN PATENT DOCUMENTS

FR 2984430 A1 6/2013
JP H1088790 A 4/1998
(Continued)

OTHER PUBLICATIONS

Aug. 19, 2015—International Search Report and Written Opinion of PCT/NL2015/050392.

*Primary Examiner* — Alvin C Chin-Shue
(74) *Attorney, Agent, or Firm* — Banner & Witcoff, Ltd.

(57) ABSTRACT

A scaffolding coupler intended for fixed attachment to the ends of a ledger of a scaffolding system. The scaffolding coupler comprises a foot and a hook which is integrally connected with the foot. The hook has a radial inside contour which is substantially circular segmental. The scaffolding coupler has at least one supporting surface which is formed by the foot and the hook and which, with the scaffolding coupler connected to a standard, rests on a supporting projection of the respective standard. The scaffolding coupler further comprises a pin which is slideably connected to the hook. The pin is configured as a bent pin, having a substantially circular segmental inside contour, which, in use, abuts directly against a pipe wall of a standard to be coupled to the first ledger or a ledger. The bent pin has a substantially circular segmental outside contour which abuts against the substantially circular segmental inside contour of the hook.

13 Claims, 16 Drawing Sheets

(51) Int. Cl.
*E04G 1/12* (2006.01)
*E04G 7/32* (2006.01)

(56) References Cited

FOREIGN PATENT DOCUMENTS

| | | | | | |
|---|---|---|---|---|---|
| JP | H11131793 | A | | 5/1999 | |
| JP | 2004278262 | A | | 10/2004 | |
| NL | 2003206 | C | | 1/2011 | |
| WO | WO-03102330 | A1 | * | 12/2003 | ..... E04G 7/304 |
| WO | 2011008094 | A1 | | 1/2011 | |
| WO | 2012/128630 | A1 | | 9/2012 | |

* cited by examiner

SCAFFOLDING COUPLER, STANDARD AND SCAFFOLDING SYSTEM

CROSS-REFERENCE TO RELATED APPLICATIONS

This application is a U.S. National Stage application under 35 U.S.C. § 371 of International Application PCT/NL2015/050392 (published as WO 2015/187010 A1), filed Jun. 2, 2015, which claims the benefit of priority to NL 2012924, filed Jun. 2, 2014. Benefit of the filing date of each of these prior applications is hereby claimed. Each of these prior applications is hereby incorporated by reference in its entirety.

FIELD

The invention relates to a scaffolding coupler which is fixedly connected with the ends of a ledger and serves for coupling the ledger to a standard or to another ledger. The invention further relates to a standard and to a scaffolding system comprising standards and ledgers.

BACKGROUND

WO2012/128630 relates to a scaffolding system of the type where the standards comprise supporting projections which are formed through plastic deformation of the pipe wall of the standard. The ledgers comprise couplers with the aid of which a ledger can be attached to a standard, whereby the coupling rests on a supporting projection of the standard in a ledger connecting zone of this standard. As the projections are provided through plastic deformation of the pipe wall, they do not lead to weight increase of the standard, as is the case with scaffolding systems where the standards comprise annular flanges. As a result, the supporting projections and hence the ledger can be disposed at a smaller distance from each other than the mutual distance customary with annular flanges. This offers the advantage that ledgers can be connected to standards at many different levels, which provides a greater constructive flexibility when erecting scaffolding. Another advantage of the known scaffolding coupler is that each supporting projection can support two scaffolding couplers, so that two aligned ledgers can be connected to the standard.

Generally, a scaffolding system comprises at least two standards, longitudinal ledgers and transverse ledgers. A drawback of the system described in WO2012/128630 resides in the couplers of transverse ledgers resting on the couplers of the longitudinal ledgers which in turn rest on a supporting projection, or the other way around. When, with a standard, the transverse ledger couplers rest on longitudinal ledger couplers, then, viewed in transverse direction, with the neighboring standards, longitudinal ledgers should be used too, because otherwise there is nowhere to rest the transverse ledgers that have to be connected to the standards. In some cases, this leads to placement of a larger number of longitudinal ledgers than required from a viewpoint of strength and rigidity of the entire scaffolding. The additional longitudinal ledgers are only necessary for supporting the scaffolding couplers of the transverse ledgers. The consequences are that it takes longer to erect the scaffolding and that a larger amount of longitudinal ledgers is required for erecting the scaffolding. Both consequences lead to high costs of the scaffolding, which is undesired.

The scaffolding coupler known from WO2012/128630 comprises four parts, a first casting comprising a foot and a hook integrally connected therewith, a securing element, a hinge pin with the aid of which the securing element is pivotally connected to the hook, and a wedge which is slideably received in a wedge opening in the hook. This scaffolding coupler requires several mounting operations in order to be assembled. Due to the four parts and the mounting operations, the known scaffolding coupler is relatively expensive. Another drawback of the known scaffolding coupler is that the wedge has to be struck into place at a first free end of the wedge and that the wedge can be knocked loose again from a diametrically opposed side of the ledger at a second free end of the wedge. In some cases, when erecting and dismantling scaffolding, this is quite impractical as regularly, one of the free ends of the wedge is poorly accessible for a hammer, so that knocking the wedge loose can only be done with much effort.

SUMMARY OF THE INVENTION

The invention contemplates a scaffolding coupler which, while maintaining the above described advantages of the known scaffolding coupler, remedies the above described disadvantages of the known scaffolding coupler at least in part. It should be noted that the above described disadvantages and problems have been recognized by the inventor and therefore do not form part of the state of the art. More particularly, the object of the invention is a scaffolding coupler which consists of fewer parts and hence can be manufactured at a lower cost price.

To this end, the invention provides a scaffolding coupler intended for fixed attachment to the ends of a ledger of a scaffolding system, wherein the scaffolding system comprises standards and ledgers, wherein each standard comprises:

- an elongate pipe wall with a central longitudinal axis; and
- a number of supporting projections extending substantially in tangential direction of the pipe wall which are formed through plastic deformation of the pipe wall, each supporting projection, viewed in a tangential direction of the pipe wall, when the standard is vertically oriented, comprising a number of alternately arranged raised parts and lowered parts;

wherein the scaffolding coupler comprises:

- a foot which has a first side which is configured for the fixed connection with a ledger pipe end of a first ledger, a second side of the foot, which lies opposite the first side, forming a pipe support surface for abutment against the pipe wall of a standard or ledger;
- a hook which is integrally connected with the foot, the hook having a radial inside contour which is substantially circular segmental;
- at least one supporting surface which is formed by the foot and the hook and which in the connected condition of the scaffolding coupler with a standard rests on a supporting projection of the respective standard, the supporting surface being provided with at least one recess which is configured for receiving a raised part of this supporting projection for tangential orientation of the scaffolding coupler relative to the standard;
- a pin which is slideably connected with the hook;
  - characterized in that the pin is a bent pin, which is provided with a substantially circular segmental inside contour located on a radial inside of the bent pin, and which, in use, abuts directly against a pipe wall of a standard, or a ledger, to be coupled to the first ledger, wherein the bent pin has a substantially circular segmental outside contour which is located on a radial outside of the bent pin and which abuts against the substantially circular segmental inside contour of the hook, while the inside contour of the bent pin, together with pipe support surface define a pipe receiving space having a central longitudinal axis which in coupled condition with a standard or ledger substantially coincides with a central longitudinal axis of such standard or ledger, the inside contour and the outside contour of the pin being oriented relative to each other such that a radial thickness of the bent pin viewed from a first free end towards a second free end of the pin gradually increases, the bent pin being received in the hook in a manner slideable in tangential direction.

The scaffolding coupler therefore consists of only two parts, i.e., a first part comprising the foot and the hook and a second part which is formed by the bent pin. In one embodiment, both parts can also be configured as a casting or forging. Such a scaffolding coupler consisting of only two parts can be manufactured relatively inexpensively. The bent pin provides for clamping of the scaffolding coupler on a scaffolding pipe to which the scaffolding coupler is connected. The gradual increase in thickness of the pin is such that this is self-locking, which means that, once it has been struck into place, the bent pin cannot become detached by vibrations. Only by actively striking the bent pin loose can the bent pin be brought into the releasing condition, so that the scaffolding coupler can be taken from the pipe again. Further embodiments of the scaffolding coupler are described in the subclaims and will be further elucidated in the following on the basis of an example with reference to the figures.

The invention also provides a scaffolding system comprising standards and ledgers, wherein at least one of the standards comprises:

an elongate pipe wall with a central longitudinal axis; and a number of supporting projections substantially extending in tangential direction of the pipe wall which are formed through plastic deformation of the pipe wall, each supporting projection, viewed in a tangential direction of the pipe wall, when the standard is vertically oriented, comprising a number of alternately arranged raised parts and lowered parts;

wherein at least one of the ledgers at at least one of the ends comprises a scaffolding coupler according to the invention.

Finally, the invention contemplates a scaffolding system that remedies the above described disadvantages of the known scaffolding system at least in part.

The invention contemplates the provision of a standard and scaffolding system with such standards whereby transverse ledgers and longitudinal ledgers can be connected to the standard in a ledger connecting zone of the standard independently of each other.

To this end, the invention provides a standard for the purpose of a scaffolding system comprising a plurality of such standards and a plurality of ledgers, wherein the ledgers at their ends comprise scaffolding couplers which are configured for connecting such ledger with such standard. According to the invention, each standard comprises:

an elongate pipe wall with a central longitudinal axis; and a number of ledger connecting zones which viewed in the longitudinal direction of the standard are mutually spaced apart at a regular distance, each ledger connecting zone being associated with a single floor of a scaffolding system that is erected with such standards, while in each ledger connecting zone a first supporting projection is provided for supporting the scaffolding couplers of ledgers which extend in a first direction, and wherein the standard comprises in each ledger connecting zone at a small distance above such first supporting projection a second supporting projection for supporting scaffolding couplers of ledgers which extend in a second direction, the second direction differing from the first direction, wherein each supporting projection is formed through plastic deformation of the pipe wall, and wherein both the ledgers extending in the first direction and the ledgers extending in the second direction are associated with the same floor when these ledgers are all connected with the same ledger connecting zone of a respective standard.

The invention further provides a scaffolding system comprising thus configured standards.

Such standards and such a scaffolding system, which can also be utilized with the scaffolding couplers that are shown and described in, for instance, WO2012/128630, offer the advantage that the scaffolding couplers of the transverse ledgers do not rest on the scaffolding couplers of the longitudinal ledgers or the other way around. Instead, the scaffolding couplers of the longitudinal ledgers have, in each ledger connecting zone, their own associated supporting projection on the standard and the scaffolding couplers of the transverse ledgers have, in each ledger connecting zone, their own associated supporting projection on the standard. Consequently, there is no need to place longitudinal ledgers which are not necessary from a viewpoint of strength and rigidity of the scaffolding, but which would only be placed to provide a supporting surface for the scaffolding couplers of the transverse ledgers. Erecting scaffolding can thus be realized faster and with fewer ledgers than with the scaffolding known from WO2012/128630.

DETAILED DESCRIPTION

Figure 1:
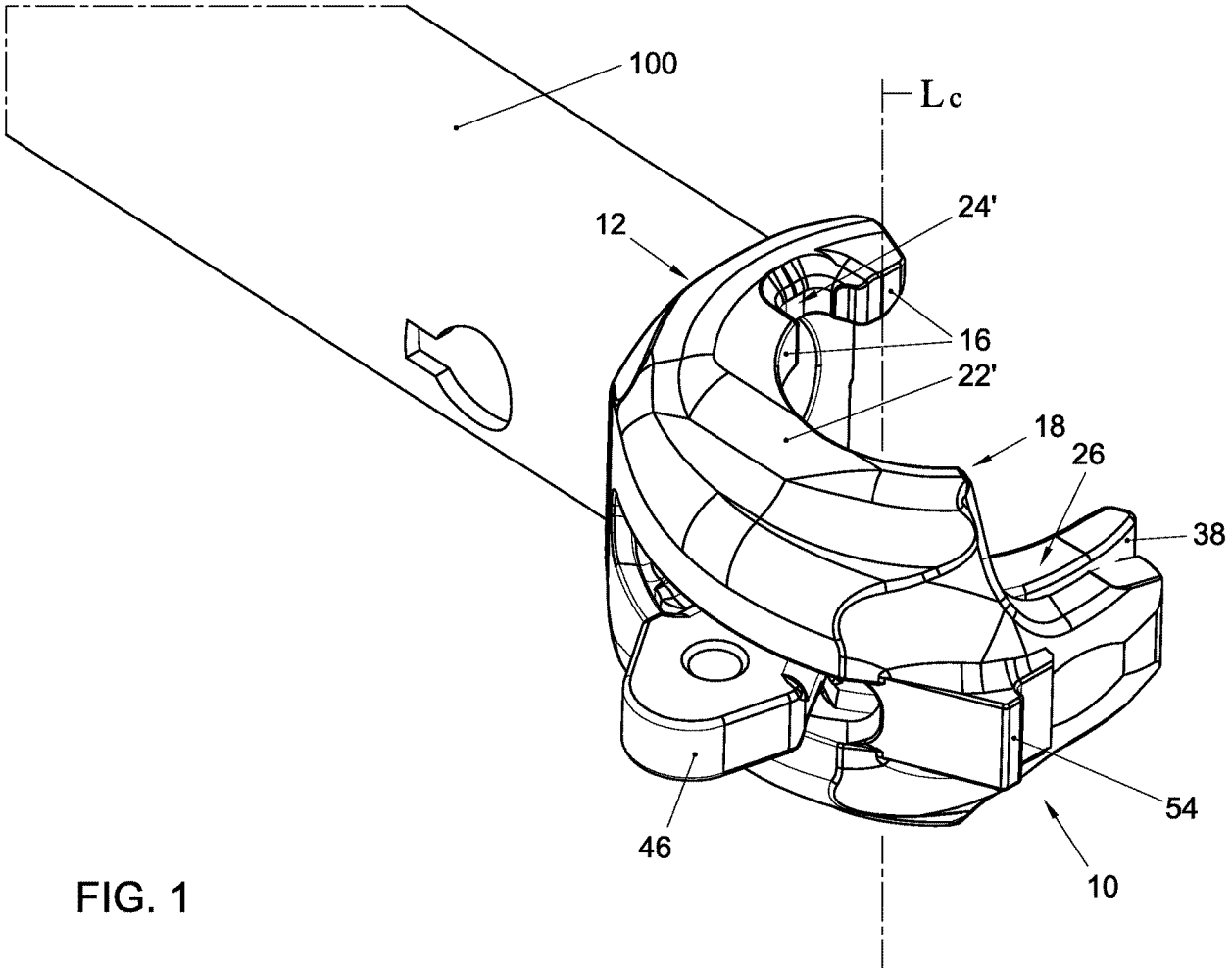
FIG. 1 shows a perspective view of an example of a scaffolding coupler which is connected to a ledger pipe end.
Figure 2:
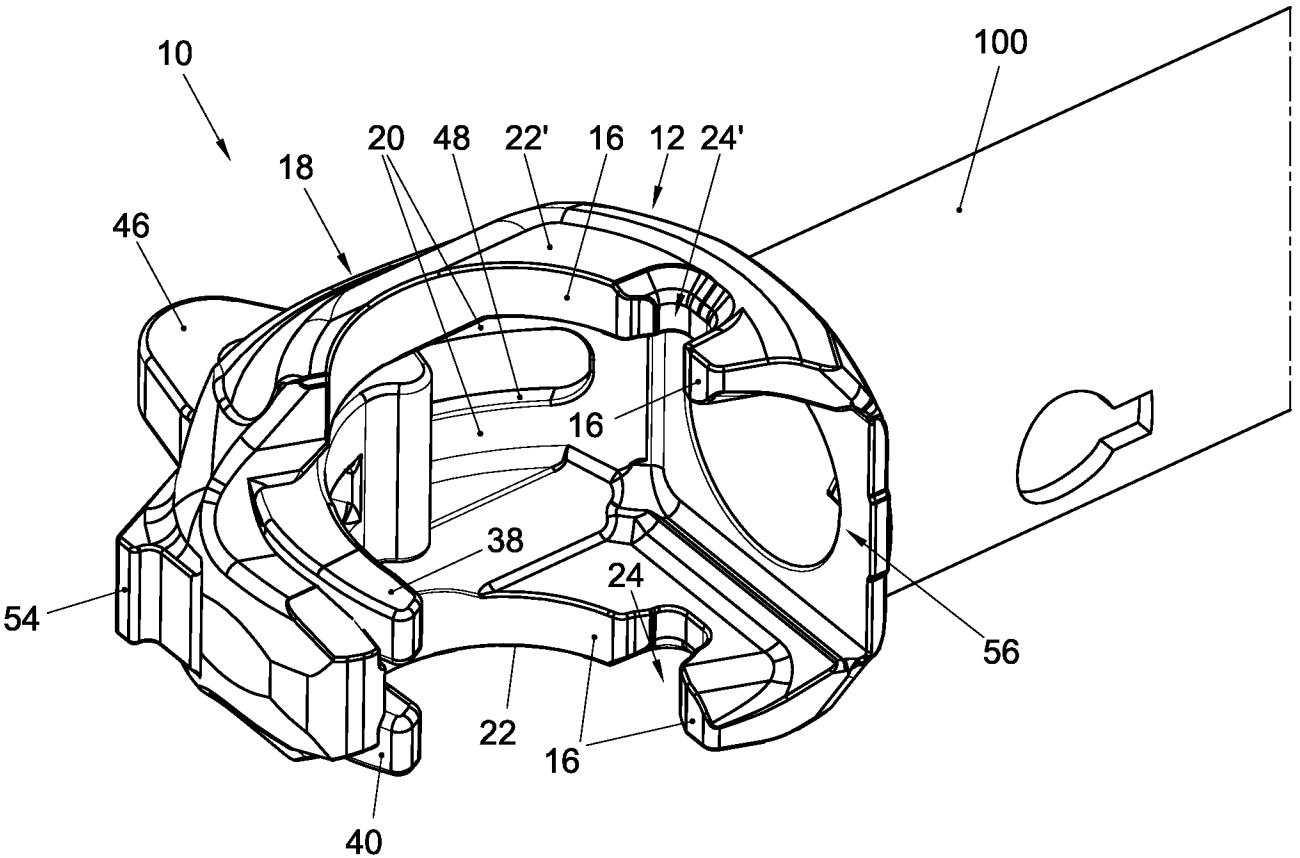
FIG. 2 shows a perspective view of the example of FIG. 1 from another point of view.
Figure 3:
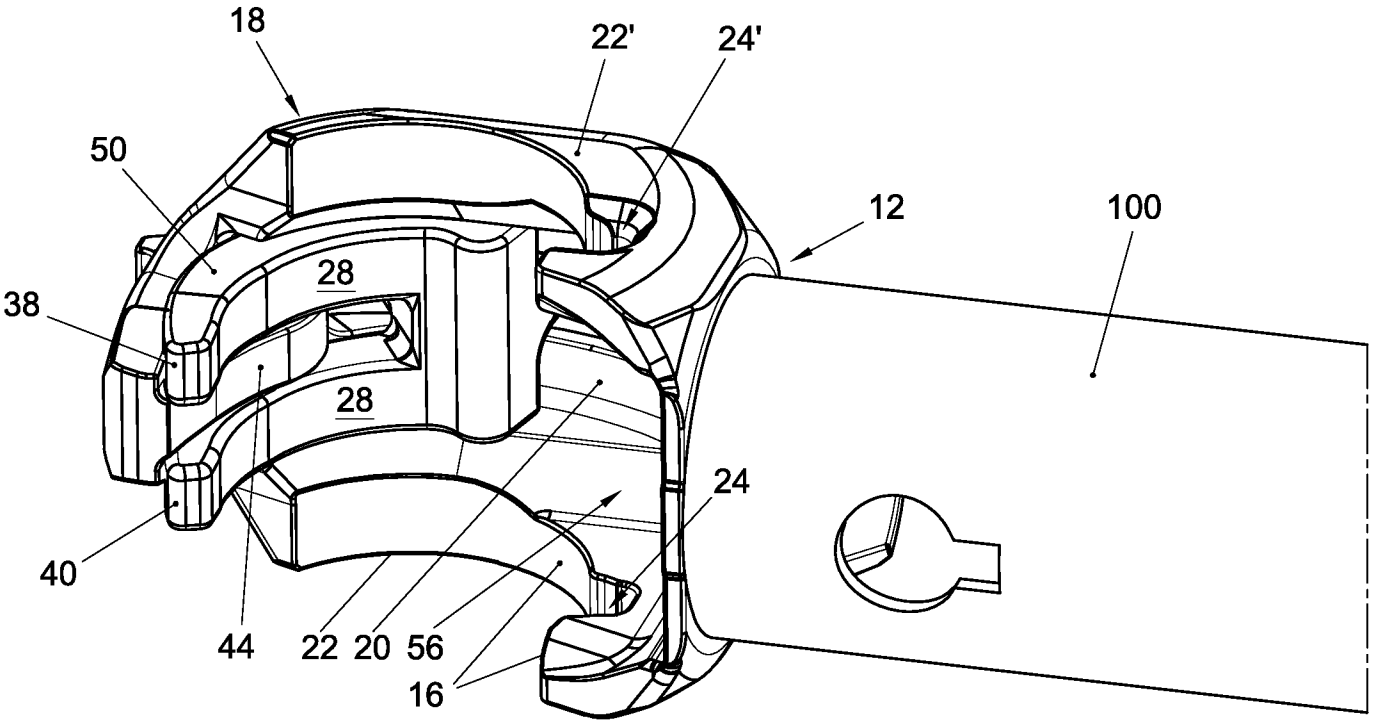
FIG. 3 shows a perspective view of the example of FIG. 1 from yet another point of view.
Figure 4:
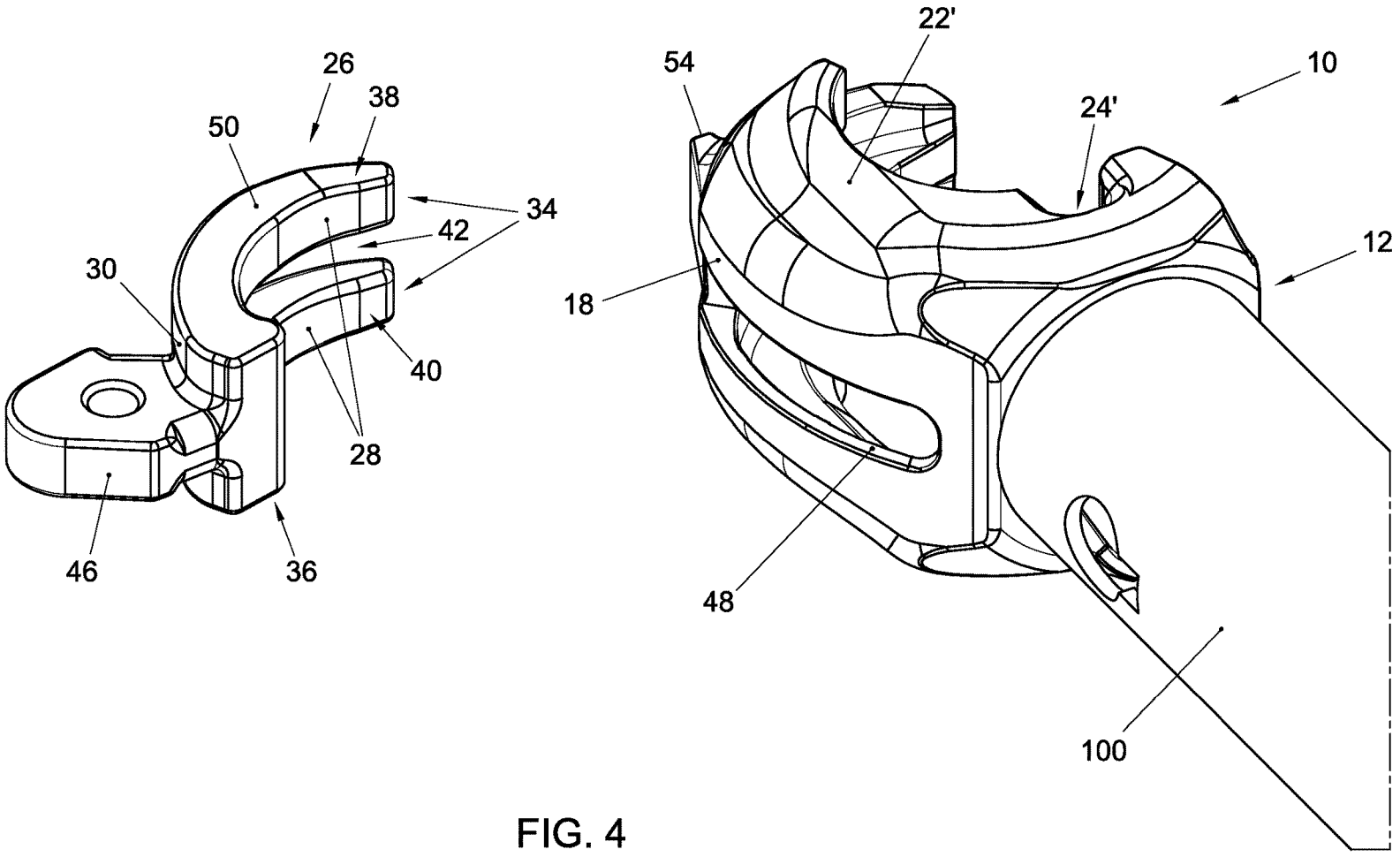
FIG. 4 shows an exploded perspective view of the example of the scaffolding coupler of FIG. 1.
Figure 5:
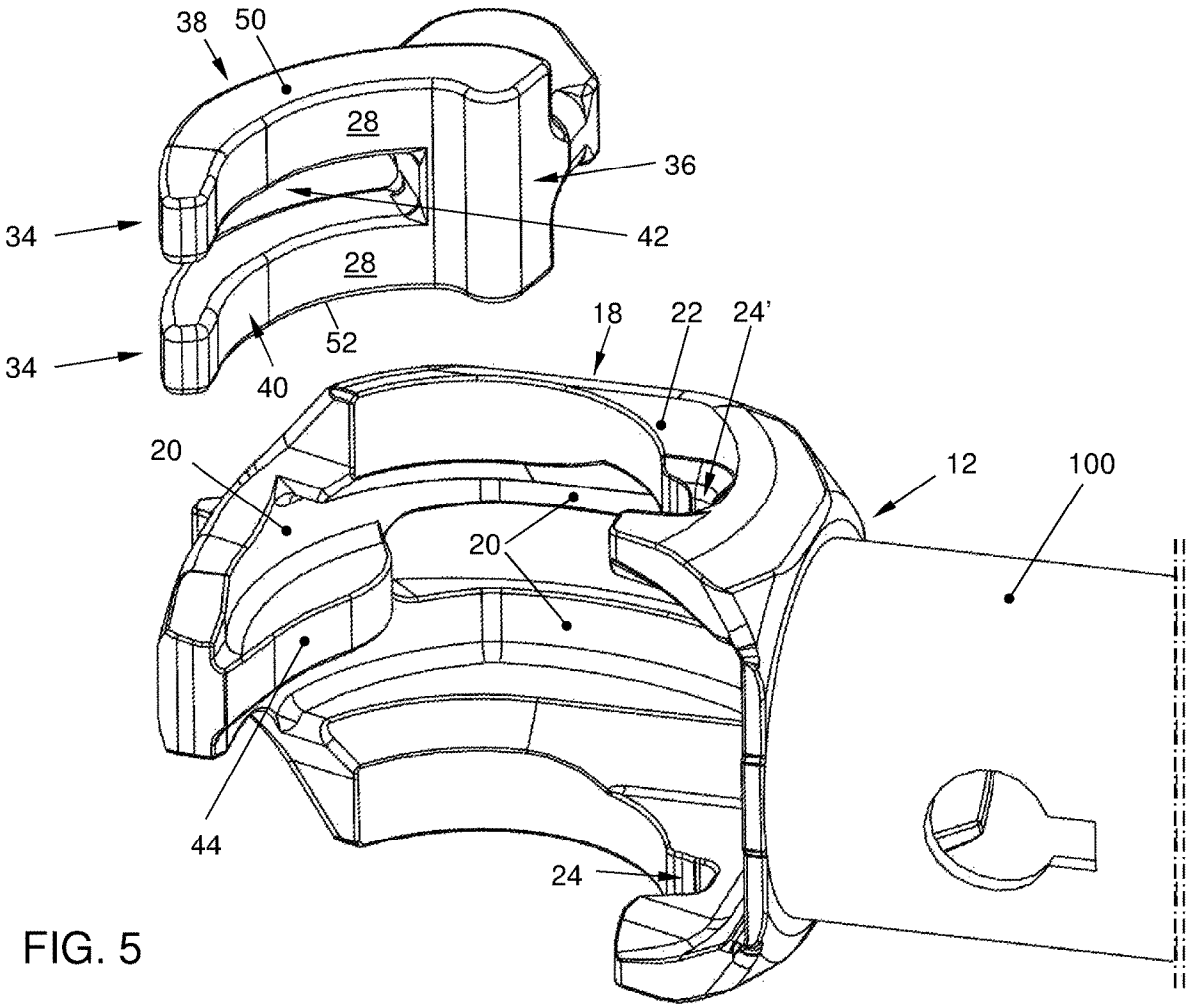
FIG. 5 shows an exploded perspective view of the example of the scaffolding coupler of FIG. 1 from another point of view.
Figure 6:
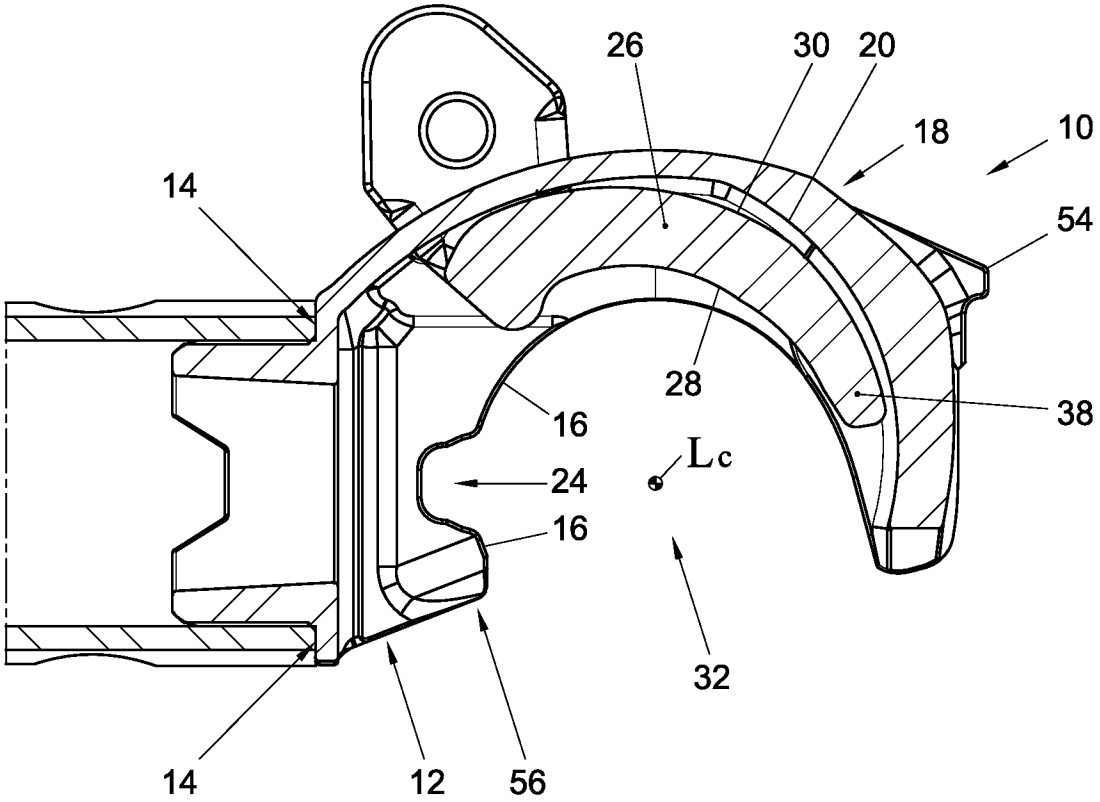
FIG. 6 shows a cross-sectional view of the example represented in FIG. 1, with the bent pin in opened position.
Figure 7:
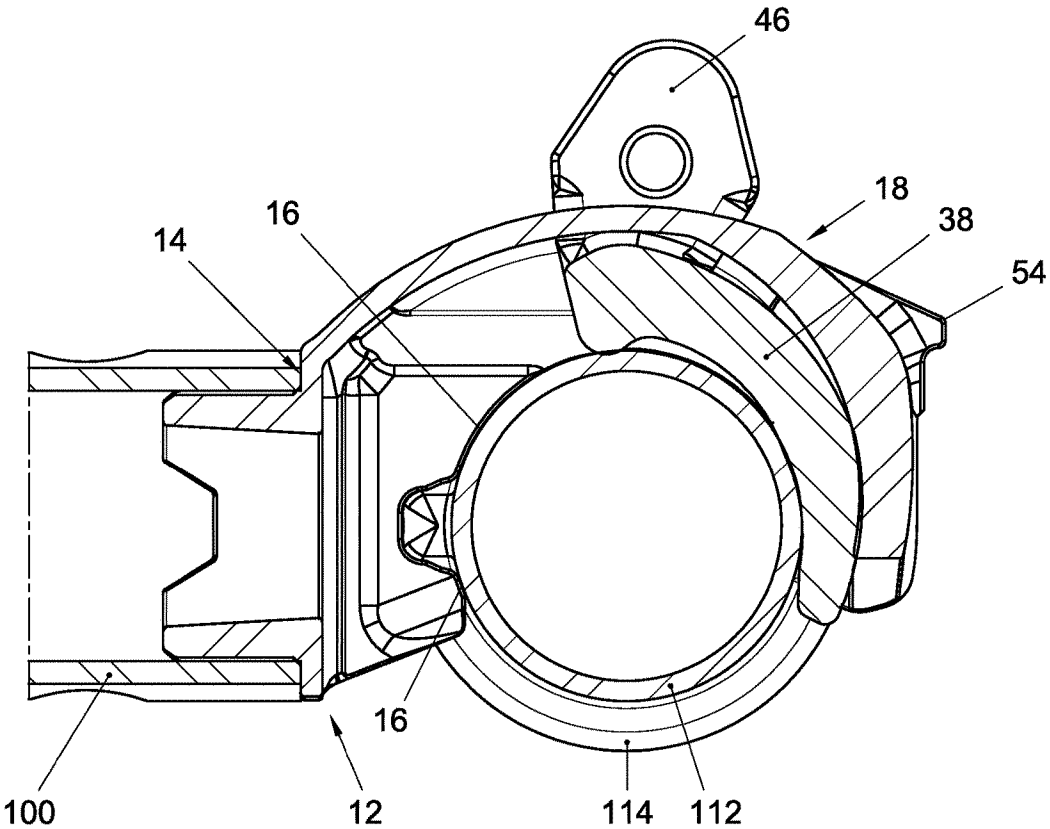
FIG. 7 shows a cross-sectional view similar to that of FIG. 6, with the bent pin in closed position and the scaffolding coupler placed on a standard.

FIGS. 1-7 show an example of a scaffolding coupler in which various embodiments as described in the subclaims are embodied. It is noted that the embodiments can also be utilized independently of each other and that the invention is not limited to the example shown in the figures. In the following, various embodiments will be described, while, with the aid of reference numerals, reference is made to the figures. The reference numerals are herein used for clarification but have no limitative effect. An embodiment can also be configured in another manner than represented in the example shown in the figures.

Figure 8:
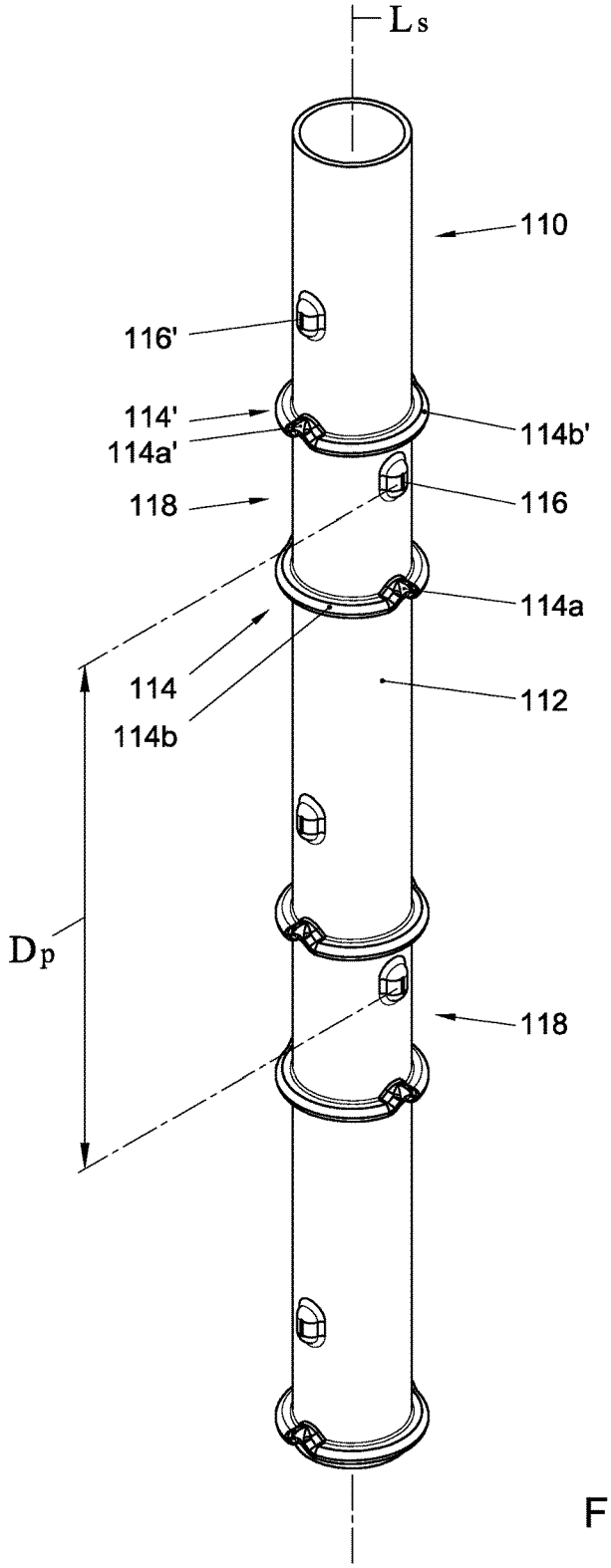
FIG. 8 shows an example of a standard of an embodiment of the scaffolding system.
Figure 9:
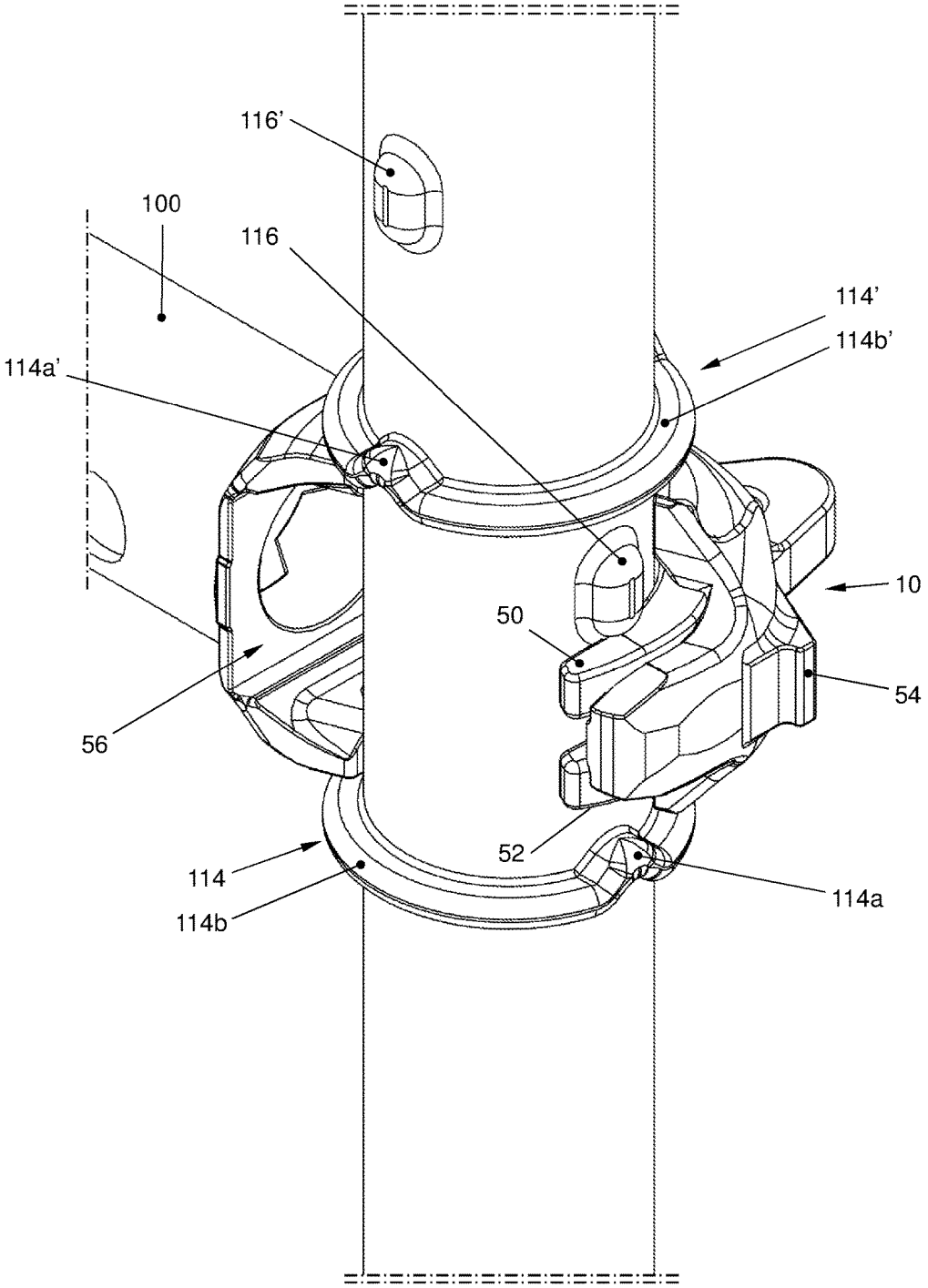
FIG. 9 shows a perspective view of a ledger connecting zone of the standard of FIG. 8 with a ledger connected thereto with a scaffolding coupler according to the example of FIGS. 1-7.
Figure 10:
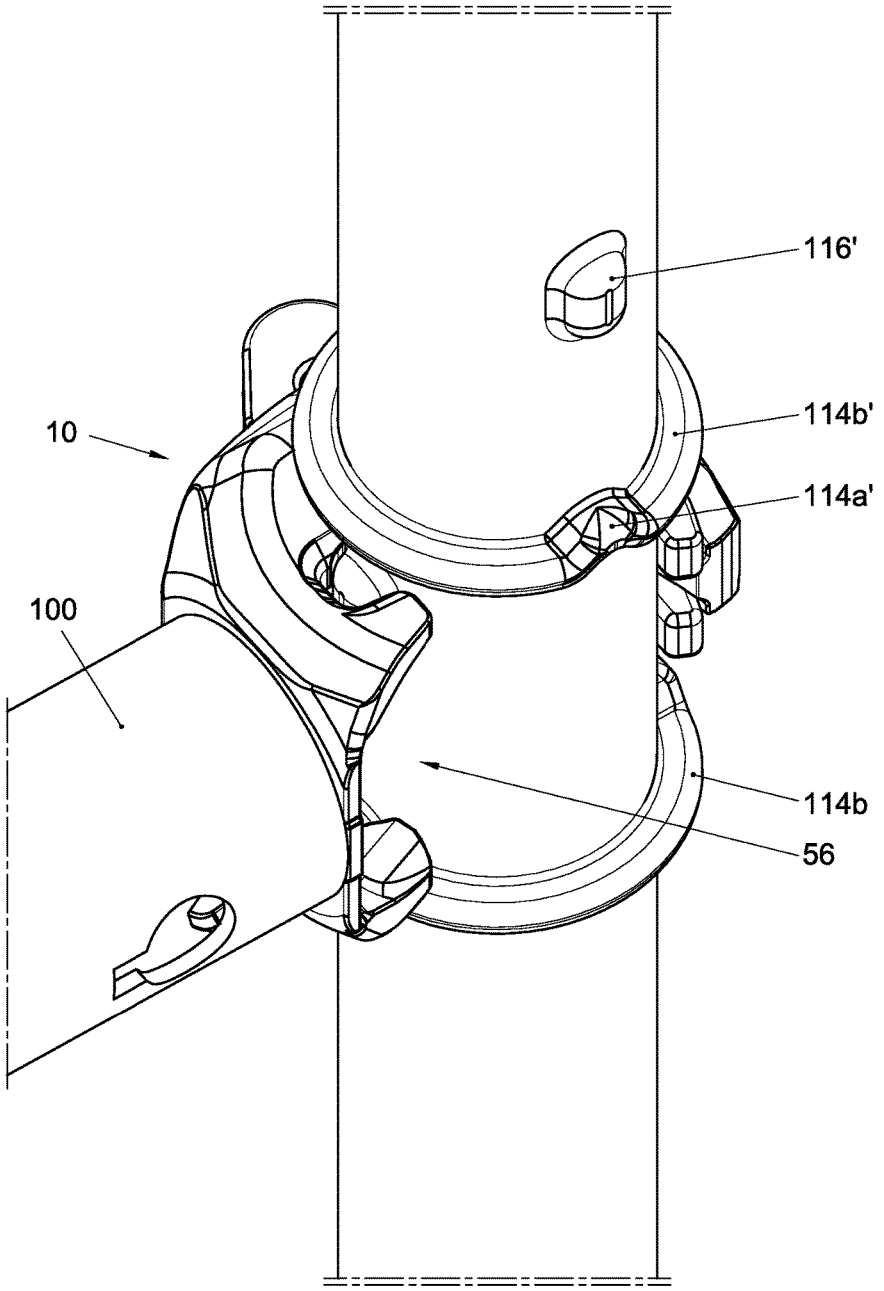
FIG. 10 shows a perspective view of the assembly of FIG. 9 from another point of view.
Figure 11:
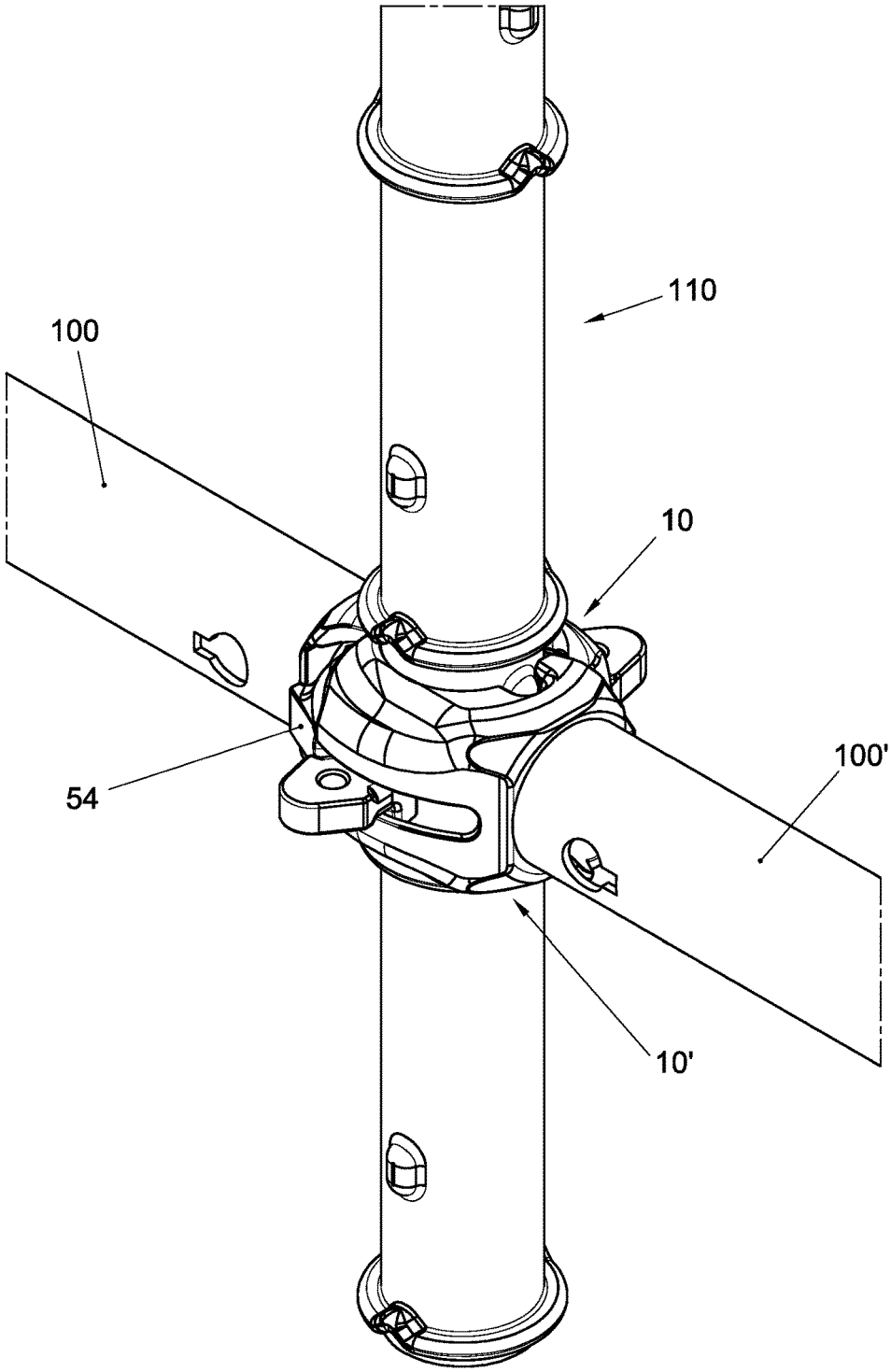
FIG. 11 shows a perspective view similar to that shown in FIG. 9, with a second ledger connected to the standard.
Figure 12:
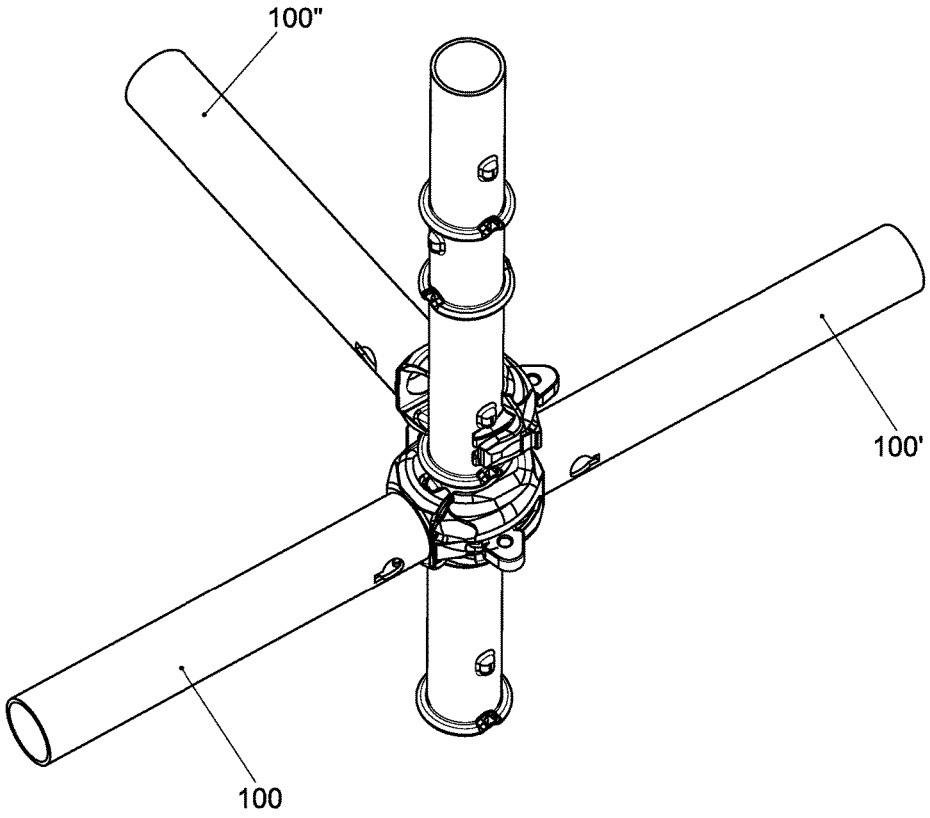
FIG. 12 shows a perspective view similar to that shown in FIG. 10, with a third ledger connected to the standard.
Figure 13:
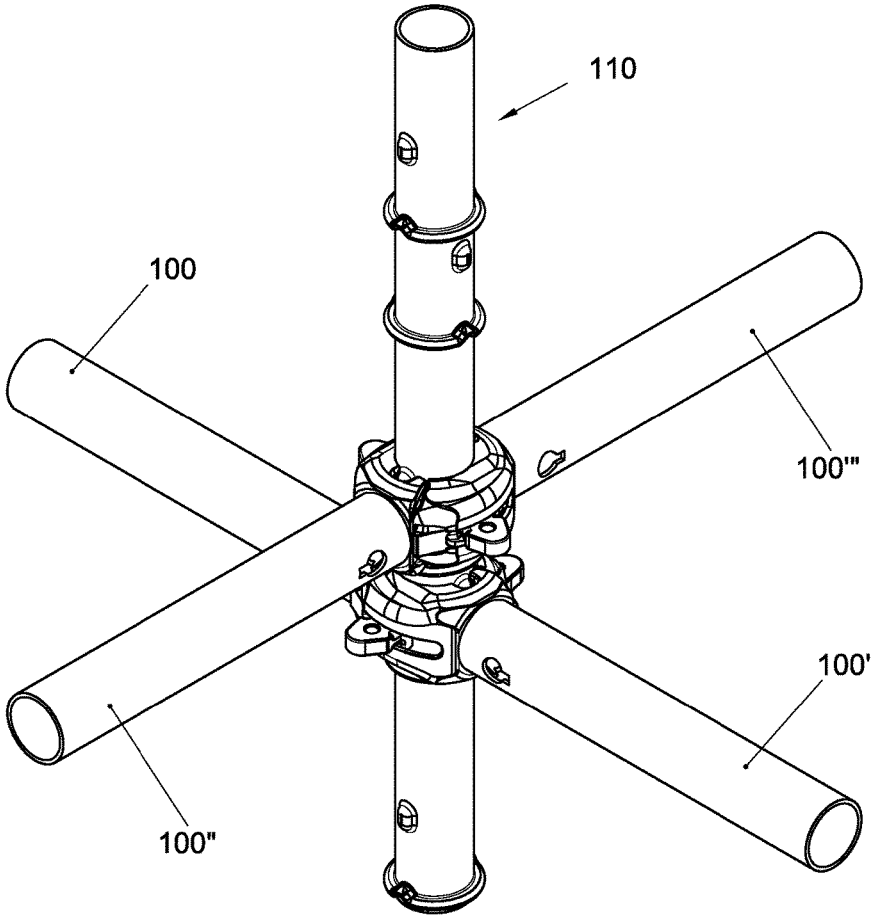
FIG. 13 shows a perspective view similar to that shown in FIG. 9, with a fourth ledger connected to the standard.
Figure 14:
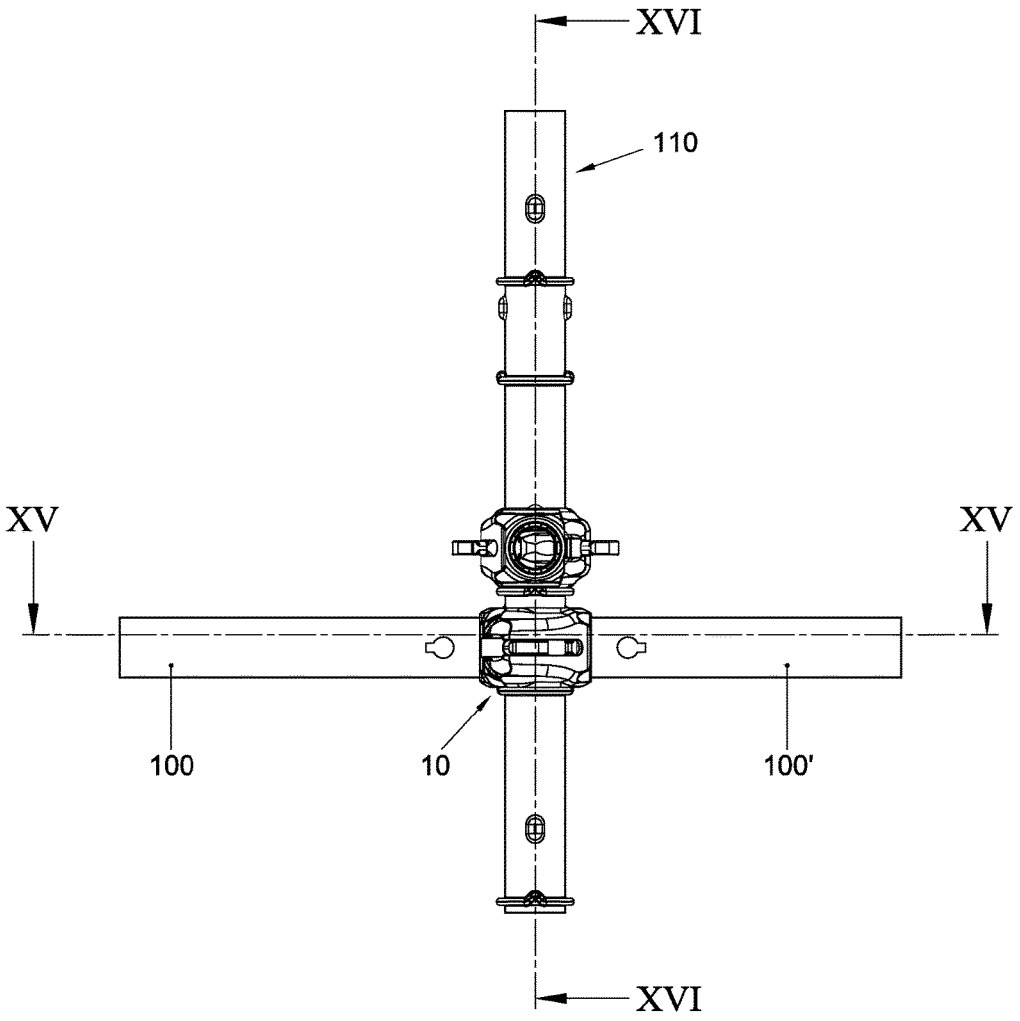
FIG. 14 shows a side view of the assembly of a standard with four ledgers shown in FIG. 13.
Figure 15:
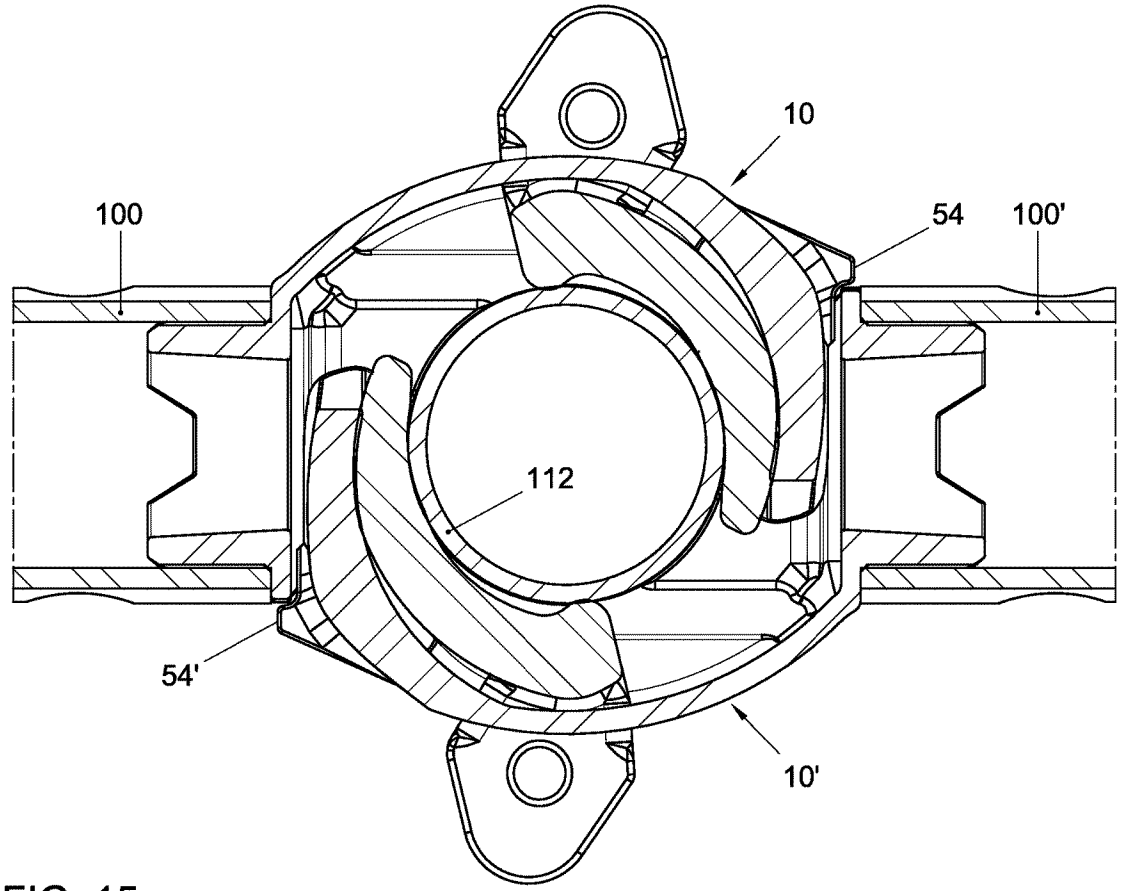
FIG. 15 shows cross section XV-XV of FIG. 14.

In the most general terms, the invention provides a scaffolding coupler 10 intended for fixed connection to the ends of a ledger 100 of a scaffolding system, for instance by means of a welded joint. The scaffolding system comprises in any case ledgers 100 and standards 110. An example of an embodiment of a standard 110 is shown in FIG. 8. Each standard 110 comprises an elongate pipe wall 112 with a longitudinal central axis Ls. The cross section of the pipe wall 112 of the standards 110 is usually circular. This also holds true for the cross section of the ledgers 100. Each standard 110 further comprises a number of supporting projections 114 which extend in tangential direction of the pipe wall 112 and which are formed through plastic deformation of the pipe wall 112. Each supporting projection 114 comprises, viewed tangentially to the pipe wall 112, with the standard 110 in vertical orientation, a number of alternately arranged raised parts 114*a* and lowered parts 114*b*.

Figure 16:
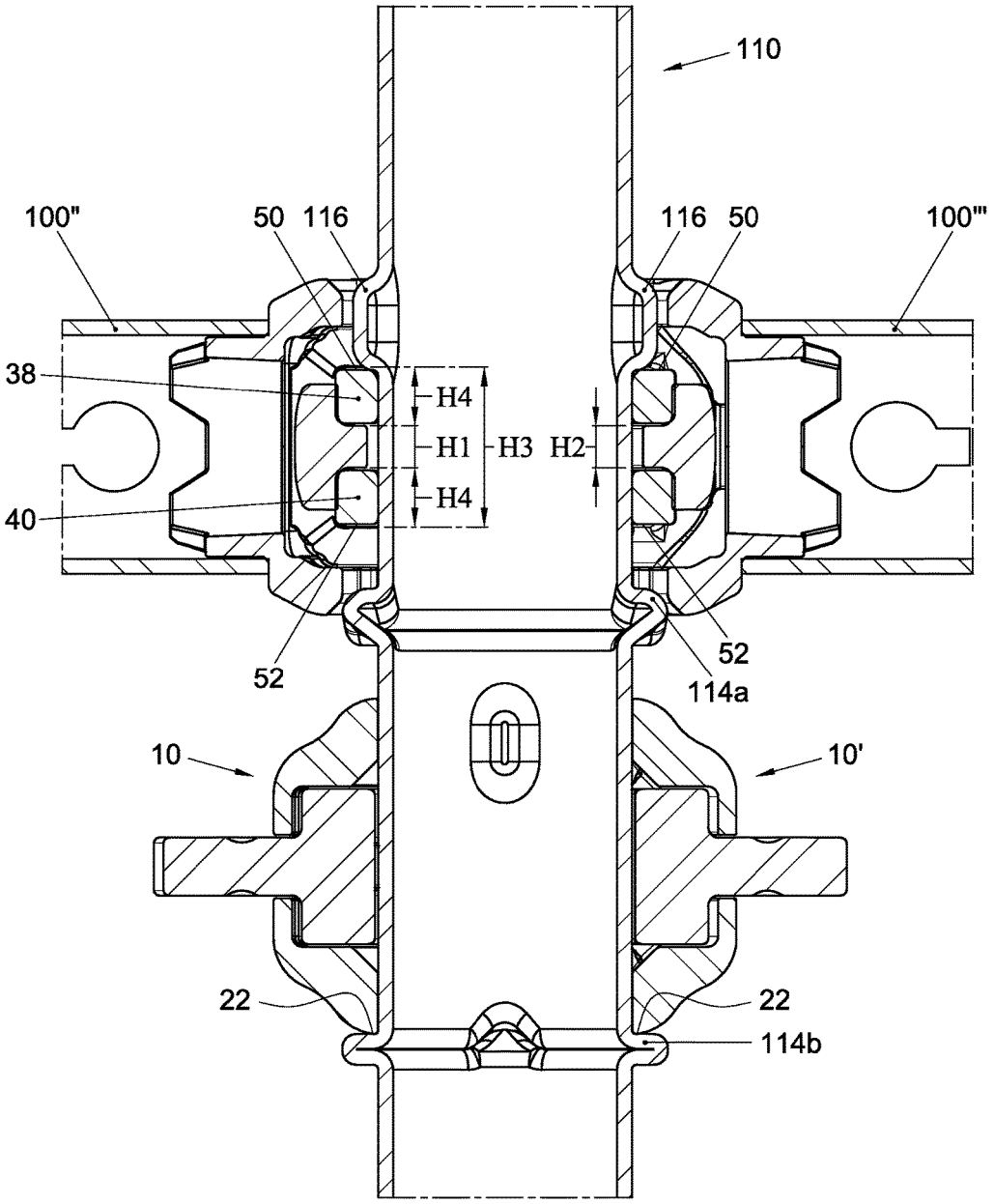
FIG. 16 shows cross section XVI-XVI of FIG. 14.

The scaffolding coupler 10 which is intended for such a scaffolding system comprises a foot 12 having a first side 14 that is configured for fixed connection to a ledger pipe end 102 of a first ledger 100. A second side of the foot 12, located opposite the first side 14, forms a pipe support surface 16 for abutment against the pipe wall 112 of a standard 110 or other ledger. A hook 18 is integrally connected with the foot 12. The hook 18 has a radial inside contour 20 which is substantially circular segmental. The scaffolding coupler 10 further has at least one supporting surface 22, 22' which is formed by the foot 12 and the hook 18 and which, with the scaffolding coupler 10 connected to a standard 110, rests on a supporting surface 114 of the respective standard 110 (see FIG. 16). The supporting surface 22, 22' is provided with at least one recess 24, 24' which is configured for receiving a raised part 114*a* of this supporting projection 114 for tangential orientation of the scaffolding coupler 10 relative to the standard 110. In the example shown, the scaffolding coupler comprises two such supporting surfaces 22, 22', a first supporting surface 22 and an opposite, second supporting surface 22'. When the scaffolding coupler 10 rests with the first supporting surface 22 on a supporting projection 114, the second supporting surface 22' faces up. When the scaffolding coupler 10 rests with the second supporting surface 22' on a supporting projection 114, the first supporting surface 22 faces up. The provision of two such supporting surfaces 22 therefore enables the ledger 100 to be connected to a standard 110 in two manners.

The scaffolding coupler 10 further comprises a pin 26 which is slideably connected to the hook 18. Characteristically, the pin 26 is a bent pin, comprising a substantially circular segmental inside contour 28 which is located on a radial inside of the bent pin 26, and which, in use, abuts directly against a pipe wall 112 of a standard 110 or a ledger to be coupled to the first ledger 100. The bent pin 26 has a substantially circular segmental outside contour 30 which is on a radial outside of the bent pin 26 and which abuts against the substantially circular segmental inside contour 20 of the hook 18. The inside contour 28 of the bent pin 26 together with the foot supporting surface 16 define a pipe receiving space 32 having a longitudinal central axis Lc which, in coupled condition with a standard 110 or ledger 100, substantially coincides with a longitudinal central axis Ls of this standard or ledger. The inside contour 28 and the outside contour 30 of the pin 26 are oriented relative to each other such that, viewed from a first free end 34 to a second free end 36 of the pin 26, a radial thickness of the bent pin 26 gradually increases. The bent pin 26 is received in the hook 18 so as to be tangentially slideable. The gradual increase of the radial thickness is preferably so gradual that the bent pin is self-locking. This implies that once it is struck in place, it does not slip loose of itself or under the influence of vibrations anymore. Only when the pin is struck loose again with, for instance, a hammer, is the pin returned to the releasing position and can the scaffolding coupler be removed from a pipe received in the pipe receiving space 32.

In one embodiment, of which an example is shown in the figures, the bent pin 26 can be fork-shaped at a first free end 34 and can comprise two fork teeth 38, 40 between which extends a fork recess 42 with a particular height H1. Here, the inside contour 20 of the hook 18 can comprise a back 44 extending in tangential direction and having a height H2 which is such that the back 44 is received substantially fittingly in the fork recess 42 so that, viewed in the direction of the longitudinal central axis Lc of the pipe receiving space 32, the bent pin 26 is fixed relative to the hook 18.

Through the use of a single back 44 on the hook 18, and two fork teeth 38, 40 on either side of this back, with a minimal total height of the hook 18, still, a maximum total height of the pin 26 can be provided. The total height of the hook 18 must be as limited as possible, to allow the height of the ledger connecting zone to be as limited as possible. Thus, the thickness of a scaffolding floor assembly, formed by longitudinal ledgers, transverse ledgers and floor parts, can be as minimal as possible, so that in the scaffolding, an optimal passage between the successive floors of the scaffolding is obtained. If the pin is not of forked design, it needs to be enclosed both at the top and at the bottom by a wall part of the hook in order to provide vertical fixation of the pin relative to the hook. These two wall parts, which each contribute to the total height of the hook, can be omitted in the present embodiment, because with a single back 44, the vertical fixation of the pin 26 relative to the hook 18 is provided. As a result, the combined height of the fork teeth 38, 40 can be increased, and the pin 26 has a larger abutting surface which engages the pipe wall 112 of the standard 110. Owing to this larger abutting surface, the forces transmitted by the pin 26 on the pipe wall 112 are distributed better, and damages to the pipe wall 112 of the standard 110 occur less readily. In other words, the scaffolding coupler according to the embodiment with fork-shaped bent pin 26 can transmit greater forces without damaging the standards 110 and therefore leads to a relatively stronger scaffolding system.

In one embodiment, of which an example is shown in the figures, the bent pin 26 can comprise, at the second end 36 thereof on the radial outside, an integrally connected engaging projection 46 which extends radially outwards from the radial outside contour 30, while the hook 18 is provided with a recess 48 extending in tangential direction, through which recess reaches the engaging projection 46 of the bent pin 26.

With the conventional scaffolding coupler comprising a wedge or pin, the pin is secured by striking one free end of the pin with a hammer and it is loosened by striking the other free end of the pin with a hammer. This implies that when mounting the known scaffolding coupler provided with a pin, the pin must be accessible to a hammer on both sides. In some cases, this is quite difficult to realize and leads to limitations to the possibilities of scaffolding erection. The engaging projection 46 according to the above described embodiment has the advantage that both for securing and for loosening the bent pin 26 with a hammer, the same engaging projection 46 can be struck with a hammer. The scaffolder will therefore be sure that he can release the pin 26 of the scaffolding coupler because, as the engaging projection 46 thereof was accessible to a hammer when the scaffolding coupler 10 was being mounted, this engaging projection 46 will also be accessible to a hammer upon demounting of the scaffolding coupler 10.

In an embodiment of the scaffolding system, of which an example is shown in the figures (see, for instance, FIGS. 9-16), in addition to the supporting projections 114, the standards 110 can also comprise retaining projections 116 provided in the pipe wall 112 through plastic deformation. Here, with each supporting projection 114, at least one retaining projection 116 can be associated, while the retaining projection 116 is arranged, with the standard 110 in vertical orientation, above the supporting projection 114 associated therewith.

For such a scaffolding system, an embodiment of the scaffolding coupler 10, of which an example is shown in the figures, can comprise a bent pin 26 having a top surface 50 and a bottom surface 52. With the scaffolding coupler 10 mounted on a standard 110, the top surface 50 engages an underside of the retaining projection 116 associated with the supporting projection 114 on which rests the scaffolding coupler 10 (see FIG. 9), so that the scaffolding coupler is confined between the supporting projection 114 and the associated retaining projection 116. What is prevented in this manner is that the ledger 10 with the scaffolding coupler 10 connected thereto tilts away from the standard, even when the bent pin 26 is not yet secured. Therefore, a scaffolder can first place a ledger 10, then let go of it, for instance to grab a hammer, and only then strike in place the bent pin of the two scaffolding couplers 10 of the respective ledger 100. As the scaffolding coupler 10 is confined between the supporting projection 114 and the associated retaining projection 116, the ledger 100 remains in place.

In an embodiment, of which an example is shown in the figures, when the longitudinal central axis Lc of the pipe receiving space 32 is in vertical orientation, viewed from the first end 34 of the pin 26 to the second end 36 of the pin 26, the top surface 50 and the bottom surface 52 of the bent pin 26 can each, at an equal angle to a plane perpendicular to the central axis Lc, extend away from each other in wedge-shape configuration for forming an ascending surface. When striking the bent pin 26 in place, as a result of the obliquely oriented top surface 50 of the pin 26, designed as ascending surface, the scaffolding coupler 10 is clamped in vertical direction between the supporting projection 114 and the retaining projection 116. The bottom surface 52 of the pin is also designed as ascending surface, so that the same effect is also obtained when the scaffolding coupler is placed the other way around on a standard 110. This provides for an even more rigid connection between the respective scaffolding coupler 10 and the standard 110 as well as for a more accurate positioning of the scaffolding coupler 10 on the standard 110.

In an embodiment, of which an example is shown in the figures, at a radially outward facing part, the hook 18 can comprise a stop projection 54 which is integrally connected with the hook 18. The stop projection 54 is positioned on the hook 18 such that, when connecting to a standard 110 a first and a second ledger 100, 100' that are each in line with each other and each rest on the same supporting projection 114 of the standard 110, the foot 12 of the scaffolding coupler 10 of the first ledger 100 engages the stop projection 54' of the scaffolding coupler 10' of the second ledger 100' and vice versa (see FIG. 15). Owing to the presence of the stop projections 54, 54', the orientation of the first and the second ledger 100, 100' relative to each other is not exclusively defined by tangential orientation of the first ledger 100 and the second ledger 100' relative to the standard 110 through cooperation of the profiled supporting projection 114 with recesses 24 in the supporting surfaces 22 of the two scaffolding couplers 10, 10', but this mutual orientation is also defined by the mutual engagement of the scaffolding couplers 10, 10' of each other via the stop projections 54, 54'. As a result, the aligned ledgers 100, 100' and 100'', 100''' will have hardly any clearance relative to each other, so that a scaffolding as a whole forms a more rigid and stable construction. As the stop projection 54 of one scaffolding coupler 10 abuts against the other scaffolding coupler 10' and vice versa, two aligned ledgers 100, 100' in effect form one rigid whole, acting as a single, continuous pipe. This leads to a more rigid construction of the scaffolding as a whole.

In an embodiment, of which an example is shown in the figures, a distance between the top surface 50 and the bottom surface 52 of the pin 26, i.e., the height 113 (see FIG. 16) of the pin 26, can be at least 14 mm. In one embodiment, a distance between the mutually facing surfaces of the fork teeth 38, 40, i.e., the height of the fork recess H1, can be at least 4 mm and at most 8 mm. In one embodiment, the fork teeth 38, 40, viewed in the direction of the central axis Lc of the pipe receiving space, can have a height H4 which is at least 5 mm.

In one embodiment, of which an example is shown in the figures, near the foot 12, the scaffolding coupler 10 may be provided with a recess 56 which is configured for receiving a free end of the hook 18' and the first end 34' of the pin 26' of a second scaffolding coupler 10' of the same type when this second scaffolding coupler 10' rests on the same supporting projection 114 of a standard 110 as the respective scaffolding coupler 10. As a result, ledgers 100, 100' can be connected to a standard 110 in line with each other at the same height.

As already indicated above, the invention also relates to a scaffolding system. In the most general terms, such a scaffolding system comprises standards 110 and ledgers 100. At least one of the standards 110 of the scaffolding system comprises an elongate pipe wall 112 having a central longitudinal axis Ls and a number of supporting projections 114 extending substantially in tangential direction of the pipe wall 112, which have been formed by plastic deformation of the pipe wall 112. Each supporting projection 114 comprises, viewed in a tangential direction of the pipe wall 112, when the standard 110 is vertically oriented, a number of alternately arranged raised parts 114*a* and lowered parts 114*b*. At least one of the ledgers 100 of the scaffolding system comprises at least at one of the ends 102 a scaffolding coupler 10 according to the invention.

In an embodiment of the scaffolding system according to the invention, of which an example is shown in the figures, each standard 110, in addition to the above-mentioned supporting projections 114, can further comprise retaining projections 116 provided in the standard pipe wall 112 through plastic deformation. Here, with each supporting projection 114, at least one retaining projection 116 is associated. When the standard 110 is vertically oriented, in this embodiment, the retaining projection 116 is provided above the supporting projection 114 associated therewith.

Owing to the presence of the retaining projection 116, a ledger 100 can be placed on a standard 110 and continues to sit in this position without the pins 26 of the two scaffolding couplers 10 of the ledger 100 being secured. The ledger's falling out is prevented by the hooks 18 hooking under the retaining projections 116 of the two standards 110. This provides a great advantage in erecting scaffolding.

In one embodiment of the scaffolding system, of which an example is shown in the figures, the scaffolding couplers of the ledgers can each comprise a stop projection 54 which is integrally connected with the hook 18 on a radially outwardly facing part thereof, while the stop projection 54 is positioned on the hook 18 such that, when connecting a first and a second ledger 100, 100' to a standard 110, with the first and the second ledger being in line with each other and each resting on the same supporting projection 114 of the standard 110, the foot 12 of the scaffolding coupler 10 of the first ledger 100 engages the stop projection 54' of the scaffolding coupler 10' of the second ledger 100' and vice versa. That engagement is such that the orientation of the first and the second ledger 100, 100' relative to each other is not exclusively defined by tangential orientation of the first ledger 100 and the second ledger 100' relative to the standard 110 through cooperation of the profiled supporting projection 114 with recesses 24 in the supporting surfaces 22 of the two scaffolding couplers 10, 10', but also by the mutual engagement of the scaffolding couplers 10, 10' via the stop projections 54, 54'. Moreover, the positioning of the stop projections 54, 54' is such that the first ledger 100 and the second ledger 100' substantially behave as a single continuous pipe.

In one embodiment of the scaffolding coupler, of which an example is shown in the figures, each standard 110 can comprise, at regular distances, a ledger connecting zone 118, while in each ledger connecting zone 118 a first supporting projection 114 of the type mentioned is provided for connecting to the standard 110 of ledgers 100, 100' which extend in a first direction and in each ledger connecting zone 118, at a small distance above this first supporting projection 114, the standard comprises a second supporting projection 114' of the type mentioned for connecting to the standard of ledgers 100", 100'" which extend in a second direction.

The invention also provides a standard 110 for the purpose of a scaffolding system comprising a plurality of such standards 110 and a plurality of ledgers 100, 100', 100", 100'", wherein the ledgers 100, 100', 100", 100'" at their ends comprise scaffolding couplers 10 which are configured for connecting such ledger to a standard 110 mentioned.

According to an aspect of the invention, each standard 110 can comprise:

an elongate pipe wall 112 with a central longitudinal axis Ls: and a number of ledger connecting zones 118 which viewed in the longitudinal direction of the standard 110 are mutually spaced apart at a regular distance Dp, each ledger connecting zone 118 being associated with a single floor of a scaffolding system that is erected with such standards 110, while in each ledger connecting zone 118 a first supporting projection 114 is provided for supporting the scaffolding couplers 10 of ledgers 100, 100' which extend in a first direction, and wherein the standard 110 comprises in each ledger connecting zone 118 at a small distance above this first supporting projection 114 a second supporting projection 114' for supporting scaffolding couplers 10 of ledgers 100", 100'" which extend in a second direction, the second direction differing from the first direction, wherein each supporting projection 114, 114' is formed through plastic deformation of the pipe wall 112, and wherein both the ledgers 100, 100' extending in the first direction and the ledgers 100", 110'" extending in the second direction are associated with the same floor when these ledgers 100, 100', 100", 1000'" are all connected with the same ledger connecting zone 118 of a respective standard 110.

The ledgers 100, 100' extending in the first direction can for instance be the longitudinal ledgers and the ledgers 100", 100'" extending in the second direction can for instance be the transverse ledgers. The advantage of thus configured standards is that the transverse ledgers 100", 100'" can be placed independently of the longitudinal ledgers because the scaffolding couplers 10 of the transverse ledgers 100", 100'" do not need to rest on the scaffolding couplers of the longitudinal ledgers 100, 100', but on their own, associated supporting projection 114'.

An example of a thus configured standard 110 is clearly visible in FIGS. 8-16.

In one embodiment, of which an example is shown in FIGS. 8-16, each supporting projection 114, 114' of the standard 110 can extend substantially in tangential direction of the pipe wall 112, and each supporting projection 114, 114', viewed in a tangential direction of the pipe wall 112, when the standard 110 is vertically oriented, can comprise a number of alternately arranged raised parts **114*a* and lowered parts 114*b***.

The function of these alternately arranged raised and lowered parts **114*a*, 114*b* has already been described hereinabove. In particular, the raised part 114*a* of the supporting projection 114 can be received in recesses 24, 24' in the supporting surface 22, 22' of the scaffolding coupler resting on the respective supporting projection 114. Thus, in a simple manner, the scaffolding coupler 10 is oriented in tangential direction relative to the standard 110**.

In one embodiment, of which an example is shown in FIGS. 8-16, each standard 110 can also comprise, in addition to the supporting projections 114, 114', retaining projections 116 provided in the standard pipe wall through plastic deformation, each supporting projection 114, 114' having associated with it at least one retaining projection 116, the retaining projection 116 being arranged, when the standard 110 is vertically oriented, above the associated supporting projection 114, 114'.

As already described hereinabove, owing to the presence of the retaining projection 116, a ledger 100 can be placed on a standard 110 and continue sitting in this position without the pins 26 of the two scaffolding couplers 10 of the ledger 100 being secured. The ledger's falling out is prevented by the hooks 18 hooking under the retaining projections 116 of the two standards 110. This provides a great advantage in erecting scaffolding.

These standards 110 can also be advantageously used in a scaffolding system which is not provided with scaffolding couplers 10 according to the invention, but which has, for instance, scaffolding couplers as described in WO 2011/

008094 or WO 2012/128630. In such a scaffolding system, the supporting projections hence need not necessarily comprise, in a tangential direction of the pipe wall 112, a number of alternately arranged raised parts 114*a* and lowered parts 114*b*. For this embodiment, it is important that per ledger connecting zone 118, two supporting projections 114, 114' spaced apart at an axial distance are provided, whereby the one supporting projection 114 can be used for supporting longitudinal ledgers 100, 100' while the other supporting projection 114' can be used for supporting transverse ledgers 100", 100'". The advantages of such an embodiment of the standards 110 have already been described in the introduction to the specification and reside especially in the fact that per floor, the transverse ledgers associated with such floor can be placed independently of longitudinal ledgers associated with such floor.

The invention also provides a scaffolding system comprising a plurality of the above described standards 110 and comprising ledgers 100, 100', 100", 100'" which comprise scaffolding couplers 10 at their free ends.

In an embodiment, the scaffolding couplers 10 of the ledgers 100, 100', 100", 100'" can be configured in the manner as described in any one of claims 1-7.

In an embodiment, of which an example is shown in the figures, the slight distance between the two supporting projections 114, 114' in a ledger connecting zone 118 of the standard 110 is as small as possible, but sufficient to place on the lower supporting projection 114 at least one scaffolding coupler 10 without this interfering, upon placement, with the upper supporting projection 114'.

As the mutual distance between the two supporting projections 114, 114' within a ledger connecting zone 118 is kept minimal, the height of a scaffolding floor assembly, which comprises longitudinal ledgers, transverse ledgers and floor parts, is as small as possible. Thus, the passage between two floors of a scaffolding is obstructed as little as possible.

In an embodiment of the scaffolding system, of which an example is shown in the figures, the regular distance Dp between successive ledger connecting zones 118 may be at least 25 cm and at most 70 cm. Owing to this relatively small distance, in erecting the scaffolding, a large flexibility is obtained with respect to the positioning of the ledgers 100 on the standards 110. This allows scaffoldings to be erected for many applications.

The various embodiments described above can be applied independently of each other and combined with each other in various manners. The reference numerals in the detailed description and the claims do not limit the description of the embodiments and the claims and serve for clarification only.

The invention claimed is:

1. A scaffolding coupler intended for fixed attachment to the ends of a ledger of a scaffolding system, wherein the scaffolding system comprises a plurality of standards and a plurality of ledgers, wherein each standard comprises:

an elongate pipe wall with a central longitudinal axis; and a plurality of supporting projections, wherein each supporting projection extends substantially in a tangential direction of the pipe wall and is formed through plastic deformation of the pipe wall, wherein each supporting projection, viewed in a tangential direction of the pipe wall, when each standard of the plurality of standards is vertically oriented, comprises a number of alternately arranged raised parts and lowered parts;

wherein the scaffolding coupler comprises:

a foot which has a first side which is configured for the fixed attachment with a ledger pipe end of a first ledger of the plurality of ledgers, a second side of the foot, which lies opposite the first side, forming a pipe support surface for abutment against the pipe wall of a first standard of the plurality of standards or the pipe wall of a second ledger of the plurality of ledgers;

a hook which is integrally connected with the foot, the hook having a radial inside contour which extends along a substantially circular arc;

at least one supporting surface which is formed by the foot and the hook and which in a connected condition of the scaffolding coupler with the first standard rests on a first supporting projection of the first standard, the supporting surface being provided with at least one recess which is configured for receiving a first raised part of the first supporting projection for tangential orientation of the scaffolding coupler relative to the first standard;

an arcuate pin having a first free end and an opposite connected end wherein the connected end is slideably connected with the hook;

wherein the pin has an inside contour located on a radial inside of the arcuate pin and extending along a circular arc, and which, in use, abuts directly against the pipe wall of the first standard or the pipe wall of the second ledger, wherein the arcuate pin has an outside contour located on a radial outside of the arcuate pin and extending along a circular arc, and which abuts against the radial inside contour of the hook, wherein the inside contour of the arcuate pin together with the pipe support surface define a pipe receiving space having a central longitudinal axis which in a coupled condition with the first standard or the second ledger substantially coincides with a central longitudinal axis of the first standard or the second ledger, wherein a radial thickness of the arcuate pin viewed from the first free end towards a second free end of the arcuate pin gradually increases, wherein the arcuate pin is slideable relative to the hook in a tangential direction with the connected end sliding along the inside contour of the hook.

2. The scaffolding coupler according to claim 1, wherein the arcuate pin near the first free end thereof is of fork-shaped configuration and comprises two fork teeth between which extends a fork recess, wherein the inside contour of the hook comprises a ridge extending in tangential direction with respect to the central longitudinal axis of the pipe receiving space, the ridge having a height such that the ridge is received substantially fittingly in the fork recess, wherein the arcuate pin, viewed in the direction of the central longitudinal axis of the pipe receiving space, is fixed relative to the hook.

3. The scaffolding coupler according to claim 1, wherein the arcuate pin near the connected end thereof comprises, on the radial outside contour, an integrally connected engaging projection which extends from the radial outside contour, the hook being provided with a recess, through which reaches the engaging projection of the arcuate pin.

4. The scaffolding coupler according to claim 1, wherein each of the plurality of standards comprises, in addition to said plurality of supporting projections, a plurality of retaining projections arranged in the pipe wall through plastic deformation, each of said supporting projections having associated with it at least one of said retaining projections, being arranged, when each of the plurality of standards is vertically oriented, above the associated supporting projection, the arcuate pin having a top surface and a bottom surface, the top surface in a mounted condition of the scaffolding coupler on the first standard engaging a lower side of a first retaining projection of the plurality of retaining projections, which is associated with the first supporting projection on which rests the scaffolding coupler, such that the scaffolding coupler is confined between the first supporting projection and the first retaining projection.

5. The scaffolding coupler according to claim 4, wherein the top surface and the bottom surface of the arcuate pin, with the central longitudinal axis of the pipe receiving space in a vertical orientation, viewed from the first free end of the arcuate pin to the connected end of the arcuate pin, each at an equal angle to a plane perpendicular to the central longitudinal axis of the pipe receiving space, extend away from each other in wedge-shaped configuration for forming an obliquely oriented top surface and an obliquely oriented bottom surface, wherein, upon striking the arcuate pin in place, as a result of the obliquely oriented top surface of the pin, the scaffolding coupler is clamped in a vertical direction between the first supporting projection and the first retaining projection.

6. The scaffolding coupler according to claim 2, wherein the arcuate pin, with the central longitudinal axis of the pipe receiving space in a vertical orientation, has a top surface and a bottom surface, wherein a distance between the top surface and the bottom surface is at least 14 mm and wherein a distance between mutually facing surfaces of the fork teeth is at least 4 mm and at most 8 mm, while the fork teeth, viewed in the direction of the central longitudinal axis of the pipe receiving space, have a height which is at least 5 mm.

7. The scaffolding coupler according to claim 1, wherein the scaffolding coupler near the foot is provided with a recess which is configured for receiving a free end of the hook and a first end of an arcuate pin of a second scaffolding coupler when the second scaffolding coupler rests on the same supporting projection of the first standard as the scaffolding coupler.

8. A scaffolding system comprising a plurality of standards and a plurality of ledgers, wherein a first standard of the plurality of standards comprises:

an elongate pipe wall with a central longitudinal axis; and a plurality of supporting projections, wherein each supporting projection extends substantially in a tangential direction of the pipe wall and is formed through plastic deformation of the pipe wall, wherein each supporting projection, viewed in a tangential direction of the pipe wall, when the first standard is vertically oriented, comprises a number of alternately arranged raised parts and lowered pets;

wherein a first ledger of the plurality of ledgers at at least one of end comprises:

a scaffolding coupler according to claim 1.

9. The scaffolding system according to claim 8, wherein the first standard in addition to said plurality of supporting projections also comprises a plurality of retaining projections arranged in the standard pipe wall through plastic deformation, each supporting projection of the plurality of supporting projections having an associated retaining projection of the plurality of retaining projections that is above the supporting projection when the standard is vertically oriented.

10. The scaffolding system according to claim 8, wherein the first standard comprises a plurality of ledger connecting zones, wherein the zones are distanced relative to each other in a longitudinal direction of the first standard at a fixed distance, wherein in each ledger connecting zone a first supporting projection of said plurality of supporting projections is provided for connection of first ledger of the plurality of ledgers with the first standard of the plurality of standards, the first ledger extending in a first direction, and in each ledger connecting zone at a distance above the first supporting projection the standard comprises a second supporting projection for connection of a second ledger of the plurality of ledgers with the first standard of the plurality of standards, the second ledger extending in a second direction different from the first direction.

11. The scaffolding system according to claim 10, wherein the distance between the first and second supporting projections of one ledger connecting zone of the plurality of ledger connecting zones is a minimal distance for preventing interference of the scaffolding coupler, when placed on the first supporting projection, with the second supporting projection.

12. The scaffolding system according to claim 10, wherein the fixed distance between successive ledger connecting zones is at least 25 cm and at most 70 cm.

13. The scaffolding system according to claim 9, wherein the scaffolding coupler is provided with a stop projection which is integrally connected with the hook on a radially outwardly facing part thereof, wherein the stop projection is positioned on the hook such that upon connection of the first and a second ledger of the plurality of ledgers with the first standard, where the first and the second ledgers are in line with each other and each rest on a same supporting projection of the first standard, the foot of the scaffolding coupler of the first ledger engages the stop projection of the scaffolding coupler of the second ledger and vice versa, such that the orientation of the first and the second ledgers relative to each other is not exclusively defined by tangential orientation of the first and the second ledgers relative to the first standard through cooperation of the same supporting projection with recesses in supporting surfaces of the scaffolding coupler of the first ledger and the scaffolding coupler of the second ledger, but also by the mutual engagement of the scaffolding coupler of the first ledger and the scaffolding coupler of the second ledger via said stop projection of the scaffolding coupler of the first ledger and the stop projection of the scaffolding coupler of the second ledger and such that the first ledger and the second ledger substantially behave like a single continuous pipe.

* * * * *